US005632209A

United States Patent [19]

Sakakibara

[11] Patent Number: 5,632,209

[45] Date of Patent: May 27, 1997

[54] LIFT TABLE

[75] Inventor: Yuuji Sakakibara, Hekinan, Japan

[73] Assignee: Bishamon Industries Corporation, Ontario, Calif.

[21] Appl. No.: 299,353

[22] Filed: Sep. 1, 1994

[30] Foreign Application Priority Data

Sep. 2, 1993 [JP] Japan ..... 5-047895 U

[51] Int. Cl.[6] ..... A47B 9/00

[52] U.S. Cl. ..... 108/145; 248/588

[58] Field of Search ..... 108/144, 145, 108/147; 248/157, 277, 575, 588

[56] References Cited

U.S. PATENT DOCUMENTS

| | | | |
|---|---|---|---|
| 2,728,621 | 12/1955 | Kempter | 108/145 |
| 3,984,078 | 10/1976 | Syurhan | 248/588 |
| 4,312,491 | 1/1982 | Aondetto | 248/588 X |
| 4,573,657 | 3/1986 | Sakamoto | 248/588 X |
| 4,926,760 | 5/1990 | Sack | 108/145 |
| 5,222,709 | 6/1993 | Culley, Jr. et al. | 248/588 X |

FOREIGN PATENT DOCUMENTS

| | | | |
|---|---|---|---|
| 2625508 | 12/1977 | Germany | 248/588 |
| 56-171375 | 12/1981 | Japan . | |
| 4-13465 | 2/1992 | Japan . | |

*Primary Examiner*—Jose V. Chen
*Attorney, Agent, or Firm*—Antonio R. Durando

[57] ABSTRACT

A lift table that consists of a base and a table attached on the right and left by pairs of scissor links. The table is raised through the use of a compression spring. The spring is compressed through the weight of the load on the table, thus creating a lift table which maintains a set height for the load on the table. The spring is positioned with one end attached to either the top or bottom end of one of the pair which form the scissor-link mechanisms, and with the other end connected to the other link, which intersects the first. One end of the spring is attached to a screw slider mechanism which is adapted to move along the length of the second link.

13 Claims, 2 Drawing Sheets

LIFT TABLE

BACKGROUND OF THE INVENTION

1. Industrial Application

This disclosure is for a lift table equipped with a table which, through a scissor-link mechanism, maintains itself level with the base.

2. Description of Related Art

Previous lift-table designs include the apparatus described in Japanese Application 4-13465 (1993), which consists of a portable lift table with a spring set below the base whose upper end is attached to a series of pin holes paralleling the upper spring holder attached to one link, thus allowing for a change in the position of the spring and for adjustment of the height of the table according to the weight of the products being used on the work platform.

Another model is disclosed in Japanese Application 56-171375 (1981) having a main link attached to the portable base, a sliding horizontal shaft along the main link, and an auxiliary link with a spring between the aforementioned horizontal shaft and the area below the base of the lift table; the table is supported by the spring, and an adjustment mechanism allows the lower end of the auxiliary link to change position and allows for adjustment of the effective spring rate.

The first model mentioned above, due to its structure which allows for only discrete changes in position because of the pin holes in the upper spring holder, makes it impossible to make small adjustments in the effect of the spring rate and maintain a set height for the table to match each product and weight being used.

Moreover, because the spring is held in place by pins and pin holes, when the position is changed by pulling a pin out, the spring loses its effectiveness and there is a serious danger that the table will collapse. The 1981 model mentioned above has its adjustment mechanism set under the portable base; so, it is difficult to use. It is also difficult to ascertain the adjustment position and, since the mechanism is such that the spring does not directly act on the scissor links, stress acts on the auxiliary link and the horizontal shaft which keeps the spring in place, making the table lose its support capability.

Furthermore, since both of these models have the spring and spring holder projecting below the base, it is necessary to have casters and legs, and the base set above ground level. In addition to increasing production costs, when the ground is uneven the aforementioned projecting components may strike the ground while the entire platform is moved, and there is a possibility of damage to the platform.

SUMMARY OF THE INVENTION

This disclosure is for a lift table of simple design which allows for small adjustments in spring force even while a load of products is on it, and which is both easy to operate and reliable.

The structure comprises a base and a table connected to one another on the right and left by pairs of symmetrical scissor links; the table is raised through the use of a compression spring; the spring is compressed by the weight of a load on the table, thus creating a lift table which maintains a set height for a given load on the table. The aforementioned compression spring is positioned with one end attached to either the top or bottom end of one of the links that form the scissor-link mechanisms, and with the other end connected to the other link, which intersects the first. One end of the spring is attached to a screw slider mechanism which is adapted to move along the length of the second link.

When the mechanical slider connection attached to one end of the compression spring is screwed in the direction that causes the angle of the other end of the spring with respect to the link hinged to it to increase, resiliency to support the scissor-link mechanism increases. In contrast, when the mechanical slider is screwed in the direction in which such angle of the spring decreases, the resiliency also decreases. Therefore, the effect of the spring rate can be adjusted as one wishes to fit the weight and size of the load on it, and a set table height can be maintained. Also, since the screw motion of the mechanical linkage is adjacent to the scissor links, no projecting parts are below the base, the structure is simplified, and the base can be set directly on the ground.

DETAILED DESCRIPTION OF THE PREFERRED EMBODIMENT

Implementation of the proposed design is explained below based on the attached drawings.

Figure 1:
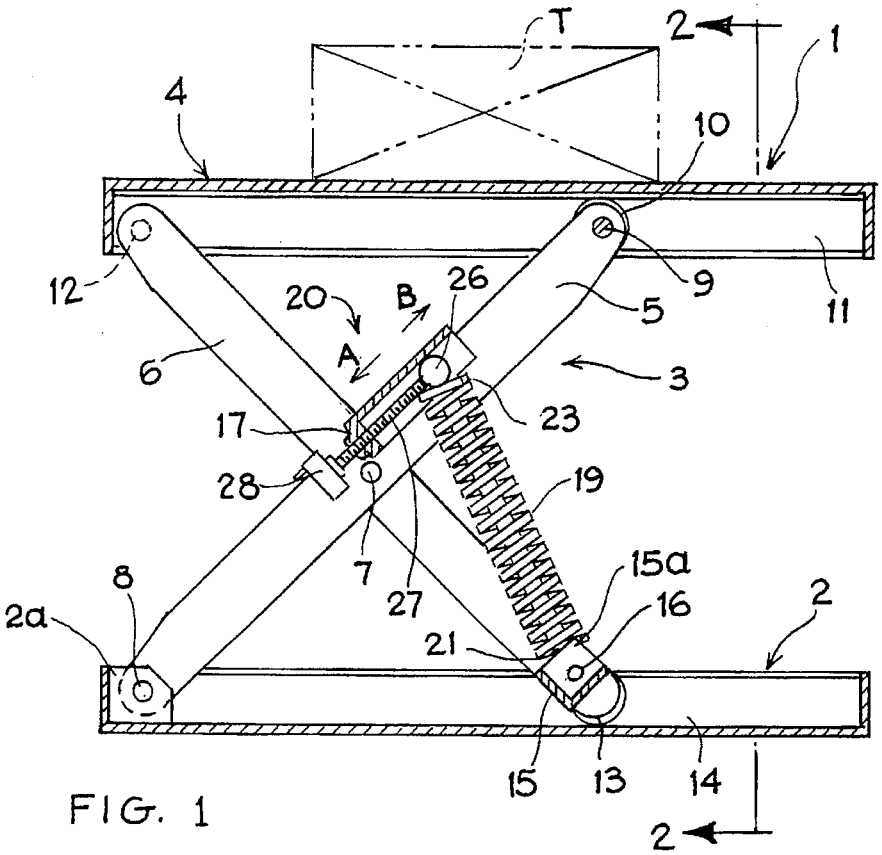
FIG. 1 is a cross section of the lift table.
Figure 2:
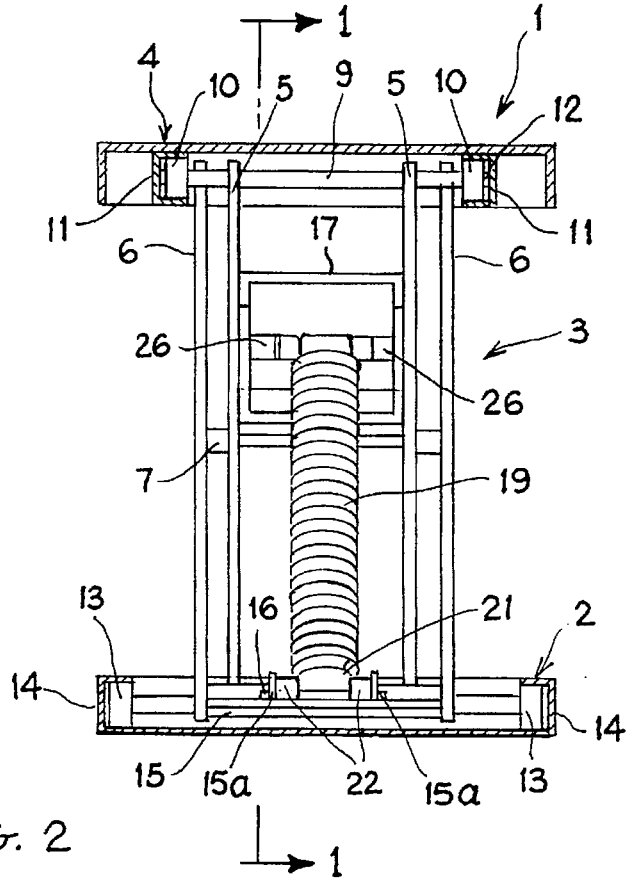
FIG. 2 is a section along 2—2 of FIG. 1.

In the cross-sections of FIGS. 1 and 2, the lift table 1 consists of a base 2, a scissor-link mechanism 3, and a table 4. The scissor-link mechanism consists of one pair of inner links 5, a corresponding pair of outer links 6, and a set of connecting pivots 7 between the sides of the links where they cross. The above mentioned inner links' lower ends are attached by pins 8 to a support structure 2*a* on one end of the base 2. The upper ends of the inner links 5 have a connecting rod 9 attached to table rollers 10. On the underside of table 4, on both sides are U-shaped section roller guides 11, which have a sliding capability. The upper ends of outer links 6 are attached by pins 12 to one end of table 4 (at one end of the roller guide 11); and the lower ends of links 6 are attached to base rollers 13 which are slidably mounted on a pair of U-shaped roller guides 14.

Figure 3:
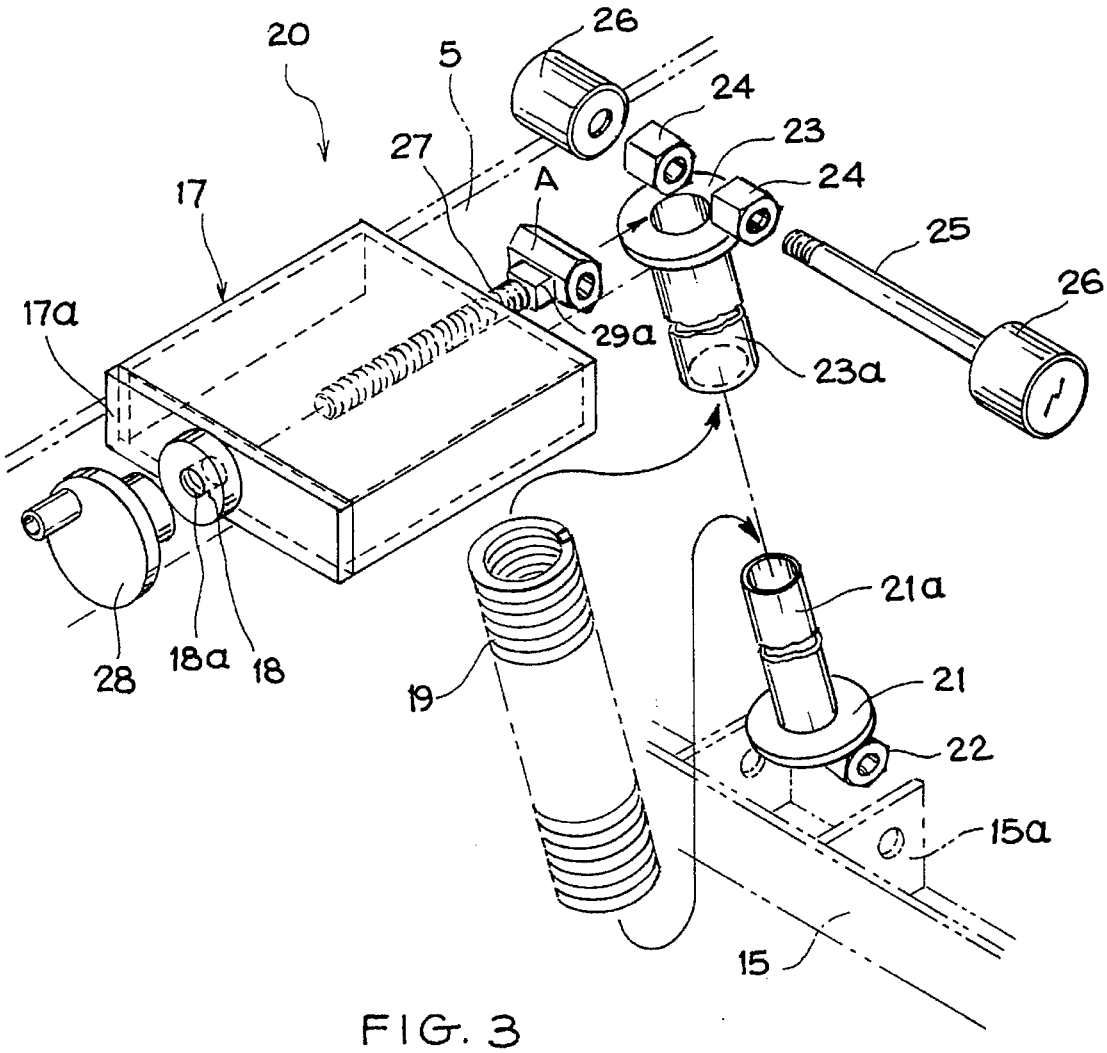
FIGS. 3 & 4 are details of the screw slider mechanism.

The scissor-link mechanism 3 includes a thrust plate 15 at the bottom of outside links 6 and comprises two pin holder plates 15*a* in the middle of the connecting plate (FIG. 3). The lower compression spring-holder 21 is hingedly connected to the holder plates 15*a* by means of nuts 22 attached to the holder 21 and a pin 16 (seen in FIG. 2).

FIG. 3 depicts in detail the screw slider mechanism 20. A guide plate 17 is built along the inner links 5 at the top of the spring 19, slightly above the connecting pivot 7; a screw hole 18*a* containing a connecting thread 18 is built into the back wall 17*a* of guide plate 17. The upper compression spring-holder 23 for the spring 19 includes two rigidly-connected nuts 24 through which a head pin 25 is threaded and screwed into the guide rollers 26 (at both ends). The compression spring 19 is coiled between the lower spring-holder 21 and the upper spring-holder 23 around the cylinder 21*a* of the lower spring-holder and around a slightly larger cylindrical sleeve 23*a* that fits over it. The spring force is directed to the guide rollers 26 inside of the guide plate 17. Further, an adjustment screw 27 fits in the screw hole 18*a* of the guide plate 17, and one end of the adjustment screw 27 projects out the back wall 17*a* of the guide plate and is fitted with a crank handle 28; the other end is attached by means of a connecting part 29*a* to a collar linkage 29 placed between nuts 24, and the head pin 25 is rotatably threaded through both. Therefore, when the adjustment screw 27 is tightened, the collar linkage 29, head pin 25, guide rollers 26, and upper spring-holder 23 all move as one in the direction of arrow B (FIG. 1); when it is loosened, they all move in the direction of arrow A.

When product T is loaded on table 4 of the above configured lift table 1, the scissor link mechanism 3 contracts according to the weight of T, the spring 19 compresses and, through the resiliency of spring 19, the table 4 is maintained in a balanced position below which it will not descend. When product T is not loaded and the handle 28 is rotated to tighten the adjusting screw 27, the upper spring-holder 23 slides inside the guide plate 17 in the direction of arrow B, along with the collar linkage 29, the guide rollers 26, and the head pin 25. As a result of this operation, the lower spring-holder 21 changes its position, the angle of the spring 19 in relation to the base 2 increases and, correspondingly, the effect of the spring rate of spring 19 supporting the table 4 is increased by an equivalent degree. In contrast, if the adjustment screw 27 is loosened, moving the collar linkage 29 and the upper spring-holder 23 inside the guide plate 17 in the direction of arrow A, the angle of the compression spring 19 in relation to the base 2 will decrease, and its resiliency will also decrease. Therefore, by determining the resiliency of the spring 19 through the use of the adjusting screw mechanism to fit the weight and size of product T loaded on table 4 as described above, one can also set the position of the table at the optimum height.

Further, since the adjustment described above is done through a screw rotation, minute adjustments can be made and, since operating adjustments are possible even when product is loaded on the table, one can choose the work conditions that corresponds perfectly to each load while avoiding the danger of the table collapsing while adjustments are made. Moreover, since the above-described screw mechanism is positioned near the center of the scissor link mechanism and the spring is adapted to push open the links directly between the base and the table, extra constituent parts are eliminated, and the overall design is simplified. Along with this, since no superfluous resistance is introduced between the spring and the links, there is an excellent responsiveness in the vertical movement of the table in relation to the weight of the product on it. The screw-rotation operation is simple, and it is a simple matter to ascertain the position of the screw.

Figure 4:
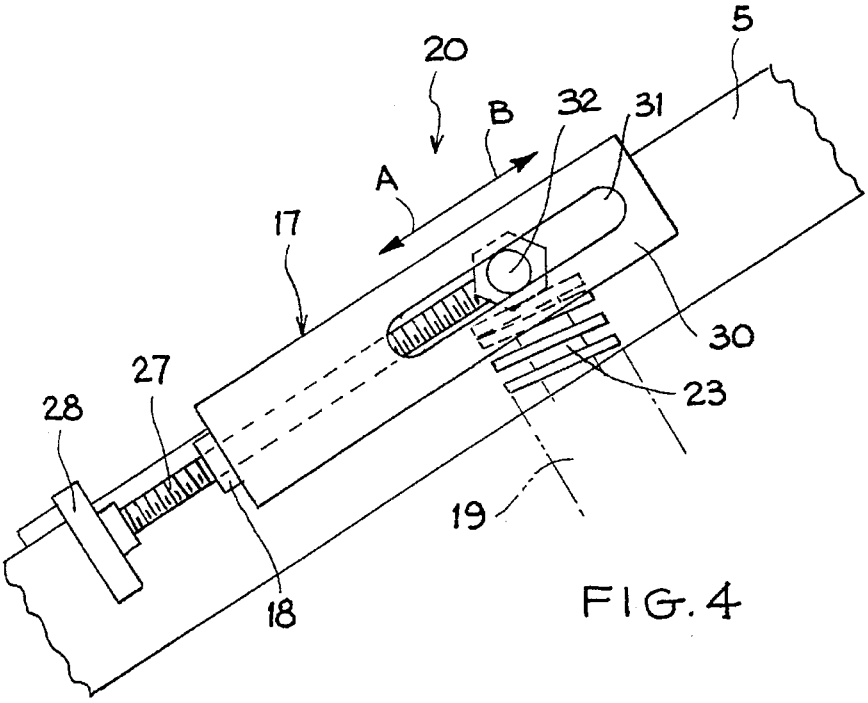

In the above implementation, the compression-spring guide rollers 26 move inside the guide plate 17; this configuration will still work if it is changed to a roller guide and a crosshead shoe. Also, as shown in FIG. 4, it would be acceptable to have a side plate 30 on both sides of the guide plate 17 facing the inner links 5, each such side plate 30 having a hole 31, and to insert both ends of a head pin 32 in the hole 31 so that the head pin 32 slides within the hole. Further, in the above implementation, the spring is set at the lower end of one of the links and near the crossing point of the other link, but it is equivalently acceptable to do the opposite; namely, to place it on the upper end of one set of links and near the spot where it crosses the other link. In addition, if the spring is set on one of the scissor links, it is effective for loads which are heavier on one side. Accordingly, it is acceptable to attach the spring together with the screw rotating mechanism on one scissor link only (either right or left), or attach the screw rotating mechanism and the spring to both sides. Similarly, the direction of motion of the screw can be towards either the front or the back of the guide plate.

With the design of this invention a user is able to adjust the resiliency of the compression spring on a continuous basis and choose the most appropriate height for the work platform so that it fits the product placed on it. At the same time, adjustment of the effective spring rate is a simple matter even with a load of product on it, and any danger of collapse of the table is eliminated. Furthermore, because the movable parts are set in the middle of the scissor link mechanism and the resiliency is directly transmitted to the link, the entire structure is simplified, and the table is more responsive to the effect of weight. In addition, it is easy to verify the set position and, from an operational standpoint, the lift table is very good and highly reliable.

Key to diagram numbers:

1. Lift table;
2. Base;
3. Scissor-link mechanism;
4. Table;
5. Inner link;
6. Outer link;
7. Connecting pivot;
8. Pin;
9. Connecting rod;
10. Table roller;
11. Roller guide;
12. Pin;
13. Base roller;
14. Roller guide;
15. Thrust plate;
16. Pin;
17. Guide plate;
18. Nut;
19. Compression spring;
20. Screw slider mechanism;
21. Lower spring-holder;
22. Nut;
23. Upper spring-holder;
24. Nut;
25. Head pin;
26. Guide roller;
27. Adjustment screw;
28. Crank handle;
29. Collar linkage.

I claim:

1. An adjustable lift table comprising, in combination:

(a) a base;

(b) a support table;

(c) a scissor-link mechanism comprising a first link hingedly attached to said base and slidably attached to said support table and a second link pivotally connected to the first link and hingedly attached to said support table and slidably attached to said base;

(d) a compression spring coupled to said scissor-link mechanism; and (e) means for providing continuous adjustment to an angular disposition of the compression spring with respect to said scissor-link mechanism consisting of a screw connected to either one of said first and second links and adapted to adjust a position of said compression spring with respect thereto.

2. The lift table of claim 1, wherein said scissor-link mechanism comprises two sets of scissor links disposed symmetrically between said support table and base, each of said sets comprising a first link hingedly attached to said base and slidably attached to said support table and a second link pivotally connected to the first link and hingedly attached to said support table and slidably attached to said base.

3. The lift table of claim 2, wherein said compression spring has one end connected to the first link of each of said sets and the other end connected to said second link of each of said sets.

4. The lift table of claim 3, wherein said screw is disposed in parallel to said either one of said first and second links.

5. The lift table of claim 4, further comprising a crank handle connected to one end of said screw.

6. The lift table of claim 5, wherein said screw is connected to either one of said first and second links through a slidable connection.

7. The lift table of claim 6, wherein said slidable connection comprises at least one roller rotatably connected to the compression spring and at least one receiving channel fixedly connected to the scissor-link mechanism.

8. The lift table of claim 1, wherein said screw is disposed in parallel to said either one of said first and second links.

9. The lift table of claim 8, further comprising a crank handle connected to an end of said screw.

10. The lift table of claim 1, wherein said compression spring has one end connected to said first link and another end connected to said second link; and wherein said means for providing continuous adjustment to the angular disposition of the compression spring with respect to said scissor-link mechanism comprises a slidable connection between said one end of the compression spring and said first link or, alternatively, between said other end of the compression spring and said second link.

11. The lift table of claim 10, wherein said slidable connection comprises at least one roller rotatably connected to the compression spring and at least one receiving channel fixedly connected to the scissor-link mechanism.

12. The lift table of claim 11, wherein said screw is disposed in parallel to said either one of said first and second links.

13. The lift table of claim 12, further comprising a crank handle connected to one end of said screw.

* * * * *